US010655909B2

(12) United States Patent
Gaplikow et al.

(10) Patent No.: US 10,655,909 B2
(45) Date of Patent: May 19, 2020

(54) REFRIGERATING APPLIANCE

(71) Applicant: BSH BOSCH UND SIEMENS HAUSGERAETE GMBH, Munich (DE)

(72) Inventors: Eugen Gaplikow, Guenzburg (DE); Karl-Friedrich Laible, Langenau (DE)

(73) Assignee: BSH Hausgeraete GmbH, Munich (DE)

( * ) Notice: Subject to any disclaimer, the term of this patent is extended or adjusted under 35 U.S.C. 154(b) by 336 days.

(21) Appl. No.: 14/549,673

(22) Filed: Nov. 21, 2014

(65) Prior Publication Data

US 2016/0146526 A1 May 26, 2016

(51) Int. Cl.

| | |
|---|---|
| ***F25D 23/12*** | (2006.01) |
| ***F25D 29/00*** | (2006.01) |
| ***F25C 5/20*** | (2018.01) |
| *G08B 21/20* | (2006.01) |
| *F25D 21/14* | (2006.01) |

(52) U.S. Cl.

CPC ..... *F25D 29/008* (2013.01); *F25C 5/22* (2018.01); *F25D 23/126* (2013.01); *F25C 2500/06* (2013.01); *F25D 21/14* (2013.01); *F25D 23/12* (2013.01); *F25D 2321/1442* (2013.01); *G08B 21/20* (2013.01)

(58) Field of Classification Search

CPC ..... F25C 5/005; F25C 2500/06; F25C 5/22; F25D 23/126; F25D 29/008; F25D 23/12; F25D 29/006; F25D 21/14; F25D 2321/1442; G08B 21/20

USPC ..... 222/108–111, 146.1, 146.6; 137/312–313, 1, 78.1, 487.5; 62/129, 62/389–400; 141/351, 360

See application file for complete search history.

(56) References Cited

U.S. PATENT DOCUMENTS

| | | | | | |
|---|---|---|---|---|---|
| 2,370,609 | A * | 2/1945 | Wilson | A47L 15/0055 | 134/191 |
| 4,733,798 | A * | 3/1988 | Brady | A47L 15/0055 | 134/113 |
| 5,349,992 | A * | 9/1994 | Gallo | B67D 1/04 | 137/358 |
| 5,551,598 | A * | 9/1996 | Cutsinger | B67D 1/1234 | 137/624.2 |
| 5,655,561 | A * | 8/1997 | Wendel | G01F 23/243 | 137/312 |
| 6,039,066 | A * | 3/2000 | Selby | F16L 35/00 | 137/312 |
| 6,135,133 | A * | 10/2000 | Ridgeway, Jr. | F24H 9/165 | 122/504.2 |
| 6,648,007 | B1 * | 11/2003 | Selby | F17D 5/04 | 137/312 |
| 6,731,215 | B2 * | 5/2004 | Harms | G08B 21/20 | 200/61.04 |
| 6,895,788 | B2 * | 5/2005 | Montgomery | A47L 15/421 | 137/312 |

(Continued)

*Primary Examiner* — Vishal Pancholi
*Assistant Examiner* — Andrew P Bainbridge
(74) *Attorney, Agent, or Firm* — Laurence A. Greenberg; Werner H. Stemer; Ralph E. Locher

(57) ABSTRACT

A refrigerating appliance includes a cabinet, a dispenser for ice and/or water mounted within the cabinet, a valve controller for outputting a valve opening signal if the dispenser requires water, and a device for making the valve opening signal available outside the cabinet.

10 Claims, 2 Drawing Sheets

(56) References Cited

U.S. PATENT DOCUMENTS 6,912,870 B2 * 7/2005 Gnadinger ..... F25C 1/04 222/14
7,082,959 B1 * 8/2006 Franklin ..... F16K 17/383 137/312
7,124,772 B1 * 10/2006 Browning ..... G08B 21/20 137/312
7,475,555 B2 * 1/2009 Janardhanam ..... F25D 23/126 222/146.6
7,561,057 B2 * 7/2009 Kates ..... G01M 3/002 340/605
7,753,071 B2 * 7/2010 Wood ..... G01M 3/16 137/312
7,810,345 B2 * 10/2010 Nebbia ..... F25D 21/14 222/146.6
8,025,186 B2 * 9/2011 Lee ..... B67D 1/0857 222/146.6
8,201,572 B2 * 6/2012 Segal ..... E03B 7/071 137/15.11
8,327,872 B2 * 12/2012 Bolduan ..... D06F 39/081 137/312
8,720,481 B2 * 5/2014 Guy ..... E03B 7/071 137/486
9,324,228 B2 * 4/2016 Trout ..... G08B 21/20
2007/0102027 A1 * 5/2007 Bang ..... A47L 15/421 134/43
2007/0181186 A1 * 8/2007 Walter ..... F17D 5/06 137/312
2008/0178626 A1 * 7/2008 Jang ..... F25C 1/24 62/344
2010/0126235 A1 * 5/2010 Bolduan ..... D06F 39/081 68/208
2010/0126602 A1 * 5/2010 Bolduan ..... D06F 39/081 137/494
2013/0048025 A1 * 2/2013 Heidel ..... A47L 15/0049 134/18
2014/0224340 A1 * 8/2014 Klee ..... E03B 7/071 137/1
2015/0027153 A1 * 1/2015 Fahnle ..... B67D 3/0009 62/129
2015/0121924 A1 * 5/2015 Faehnle ..... F25D 23/126 62/126
2015/0232315 A1 * 8/2015 Sanchez ..... B67D 1/0014 222/23
2016/0146526 A1 * 5/2016 Gaplikow ..... F25C 5/005 62/129

* cited by examiner

REFRIGERATING APPLIANCE

BACKGROUND OF THE INVENTION

Field of the Invention

The present invention relates to a refrigerating appliance such as a household refrigerator, freezer or the like which includes a dispenser for ice and/or water.

Conventional cooling appliances without a dispenser could be placed quite freely in a kitchen, without regard to the location of water spigots or faucets. Therefore, locations adjacent water spigots or faucets tend to be occupied by appliances such as dishwashers or washing machines which conventionally must be connected to a fresh water supply and to a drain for waste water, whereas the distance between the refrigerator location and the spigot or faucet can be quite long.

In order for the dispenser of the refrigerating appliance to refill automatically whenever a user has drawn off cold water or ice, the refrigerating appliance must also be connected to a water spigot or faucet. If locations close to the spigot or faucet are occupied, such a connection may have to be quite long. Quite frequently, consumers install such a connection themselves, possibly using a plastic hose of mediocre quality, which may bust if it is subjected to water mains pressure continuously for many months or years. If that happens while nobody is at home, damages can be considerable.

In order to prevent damage by water, dishwashers and washing machines are conventionally equipped with a leakage protection device known as Aqua-Stop. That device includes a solenoid valve for mounting directly at the outlet of the spigot or faucet, a hose which connects the outlet of the solenoid valve to the appliance proper, and a protective tube which extends around the hose and is non-detachably connected to the appliance body and to the body of the solenoid valve. If there is a leak in the solenoid valve, in the hose or in connections therebetween, the protective tube is flooded, and water from the protective tube will finally reach an internal leakage sensor of the appliance which responds by closing the solenoid valve.

The reliability of the Aqua-Stop device depends on the sealed connection between the protective tube and the appliance body. Therefore, washing appliances conventionally come with the Aqua-Stop device attached in a way which cannot be detached non-destructively by a user. In consequence, the user has to cope with the length of the protective tube provided by the appliance manufacturer. Since the protective tube houses both the hose and cables for controlling the solenoid valve, it tends to be rather wide and stiff, so that if it is much longer than necessary to span the distance between the appliance and the spigot or faucet, the protective tube is difficult to accommodate between the appliance and a wall in which the spigot or faucet is located. Therefore, the length of the Aqua-Stop tube is usually not much more than the width of the appliance body to which it is connected. If a refrigerator was equipped with such a short Aqua-Stop tube, it is likely that it would not span the distance between an existing refrigerator location and the spigot or faucet. If, on the other hand, the Aqua-Stop tube had a length of several meters, accommodating it would be difficult if the distance to the spigot or faucet was short. Producing refrigerating appliances with different lengths of Aqua-Stop tubes would cause serious logistic problems both in manufacture and in the retail chain. Therefore, a more flexible solution is required for reducing the risk of substantial water damage by a leak in the supply tube to a refrigerating appliance.

SUMMARY OF THE INVENTION

It is accordingly an object of the invention to provide a refrigerating appliance which overcomes the hereinafore-mentioned disadvantages of the heretofore-known appliances of this general type.

With the foregoing and other objects in view there is provided, in accordance with the invention, a refrigerating appliance comprising a cabinet, a dispenser for ice and/or water mounted within the cabinet, a valve controller for outputting a valve opening signal if the dispenser requires water, and a device for making the valve opening signal available outside the cabinet. In this case, it is the consumer's choice whether he or she wishes to install a solenoid valve controlled by the valve controller or not, and what length of tubing he or she needs for a connection between the spigot or faucet and the appliance. If desired, a suitable solenoid valve can be supplied by the appliance manufacturer along with the refrigerating appliance, and a suitable pressure-resistant hose may be provided in a length specified by the consumer by a retailer selling the appliance.

In accordance with another feature of the invention, at least one valve controlled by the valve opening signal can be provided within the cabinet, so that the flow of water to the dispenser can be interrupted even if no external solenoid valve is installed. However, even if the external solenoid valve is installed, the further valve within the cabinet is useful to prevent dripping of the dispenser after the external valve has been closed.

In accordance with a further feature of the invention, if the dispenser includes a cold water dispensing unit and an ice maker, a first valve as mentioned above may be located in a water supply line of the cold water dispensing unit, a second valve may be located in a water supply line of the ice maker, and valve opening signals for the first and second valves are available at the terminal, so as to enable the external solenoid valve to open whenever one of the two dispenser units requires water. Further, if the solenoid valve is open only while a dispenser unit requires water, pressure downstream of the external solenoid valve can be kept low most of the time, thus substantially reducing the pressure load to which the connection between the solenoid valve and the appliance are subjected.

In accordance with an added feature of the invention, the device for making the valve opening signal available outside the cabinet may include a wireless transmitter or a power line transmitter.

In accordance with an additional feature of the invention, according to a simpler embodiment, the device for making the valve opening signal available includes a terminal on the outside of the cabinet.

In principle, the terminal may be formed of any type of electrically conductive surface to which leads of a cable can be soldered, screwed or fixed in any other appropriate way. Preferably, the terminal is a connector socket, so that an electrical connection can be formed by simply plugging in a mating connector.

In accordance with yet another feature of the invention, the external valve mentioned above is preferably attached to the terminal by a flexible cable.

This cable can be separate from and independent of any hose leading from the external valve to the refrigerating appliance, so that a consumer can cut to measure and install the hose without any risk of electric shock or of damaging signal lines in the cable.

The flexible cable may be provided by the appliance manufacturer readily connected to the external valve and to the mating connector; if a predetermined length of this cable is not sufficient for the needs of a particular consumer, an extension cable can be installed between the flexible cable and the terminal of the appliance.

Since the flexible cable is much thinner and more easily bent than the conventional Aqua-Stop tube, its length can be more generously dimensioned; any length of cable that is not needed for reaching the spigot or faucet can be stored conveniently on a hook provided on the cabinet adjacent the terminal.

In accordance with yet a further feature of the invention, a connector for the water supply hose should be provided on the appliance cabinet, preferably close to a bottom thereof.

In accordance with yet an added feature of the invention, a leakage detector may be associated with the connector for the water supply hose, in order to detect at least leakage occurring at the connector.

In accordance with yet an additional feature of the invention, the leakage detector may include a collecting tray or dish underneath the connector and a water sensor associated with the collecting tray or dish.

In accordance with a concomitant feature of the invention, since refrigerating appliances conventionally have an evaporation dish for evaporating condensate which forms at an evaporator of the appliance during operation, the collecting tray may be or may communicate with such an evaporation dish, and the water sensor may be disposed so as to monitor the water level in the evaporation dish. In this way, the sensor is able to detect not only leakage but also excessive condensate formation which in the long run might also cause water to spill from the evaporation dish.

Other features which are considered as characteristic for the invention are set forth in the appended claims.

Although the invention is illustrated and described herein as embodied in a refrigerating appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
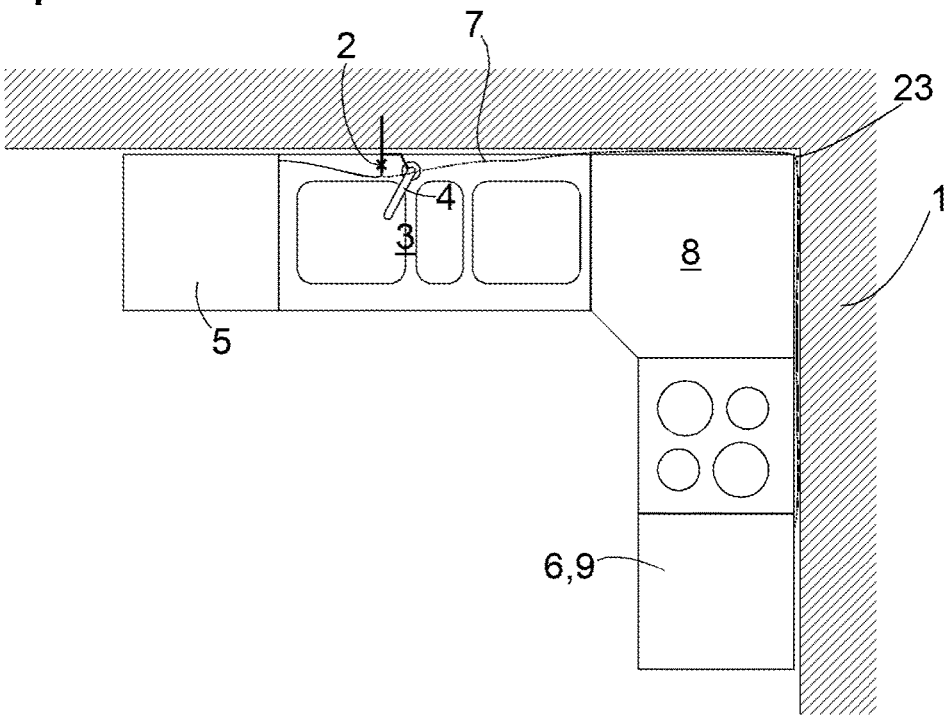
FIG. 1 is a fragmentary, diagrammatic, floor plan of a kitchen illustrating problems to be solved by the present invention.

Referring now to the figures of the drawings in detail and first, particularly, to FIG. 1 thereof, there is seen a floor plan of a kitchen in which a refrigerating appliance according to the present invention is to be used. A water spigot or faucet 2 and a non-illustrated drain hidden below a sink 3 are disposed in a wall 1 of the kitchen. The water spigot 2 is only closed in exception circumstances, if maintenance work is necessary at equipment connected downstream of the spigot 2, such as a sink-top water faucet 4 or a dishwasher 5. The dishwasher 5 occupies a location next to the sink 3, so that its connections to the spigot 2 and the drain are short. A refrigerator 6 is located rather far from the spigot, possibly because when the kitchen was first planned, there was no need for the refrigerator 6 to be connected to water mains. If a consumer wants to replace the refrigerator 6 with a new one having a water and ice dispenser, a connection to the spigot 2 must be provided. If a water supply hose or tubing 7 has to bypass a corner cupboard or cabinet 8 as shown, in order to span the distance between the spigot 2 and the refrigerator, sharp bends may be necessary, so that if the hose 7 is too wide or too stiff, pleats or kinks may form in it which in the long run may cause the hose or tubing to burst.

Figure 2:
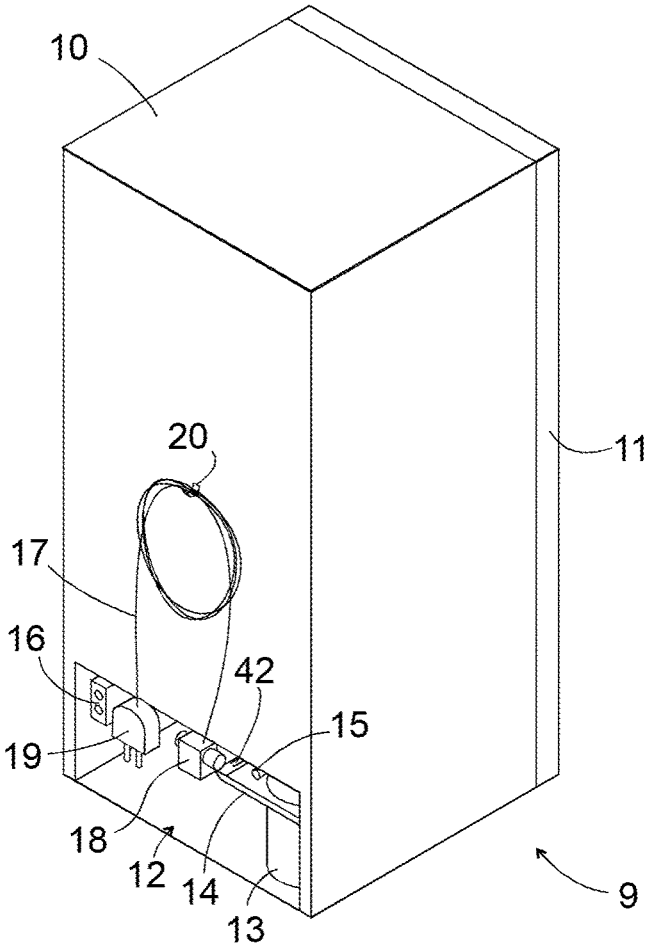
FIG. 2 a rear-perspective view of a refrigerating appliance.

A refrigerator cabinet or housing 9 suitable for installation in this location is shown in FIG. 2. As usual, the refrigerator cabinet 9 has a cuboid body 10, a door 11 which faces away from the viewer in FIG. 2, and a machinery compartment 12 which is formed in a bottom rear corner of the body 10 and accommodates a compressor 13 and possibly other components of a cooling unit, such as an evaporation dish 14 of a leakage detector and a condenser, etc. A water inlet connector 15 for connection to a water supply hose 7 is located in the machinery compartment 12 above the evaporation dish 14. A female electric connector 16 is mounted to a sidewall of the machinery compartment 12. When the refrigerator cabinet 9 is delivered to the consumer, a flexible cable 17 having a solenoid valve 18 attached to one end thereof and a male connector 19 connected to the other end thereof is suspended from a hook 20 at the rear wall of the body 10. The cable 17 may have a length of several meters, so that in most practical cases in which a room in which the refrigerator cabinet 9 is installed has a spigot for connection to the cable, the cable 17 will be sufficient to span the distance between the spigot 2 and the refrigerator cabinet 9. As is seen in FIG. 3, an adequate length of hose 7 equipped with connectors 21, 22 respectively mating an outlet of the solenoid valve 18 and the water inlet connector 15, can be provided by a retailer who installs the refrigerator cabinet 9, or may be acquired by the consumer himself or herself.

Since water consumption of the refrigerator is far lower than that of washing appliances, the cross section of the hose 7 can be quite small, e.g. 3/16" and, since the free cross section of the solenoid valve 18 need not be larger than that of the hose 7, a small and inexpensive solenoid valve can be used.

Figure 3:
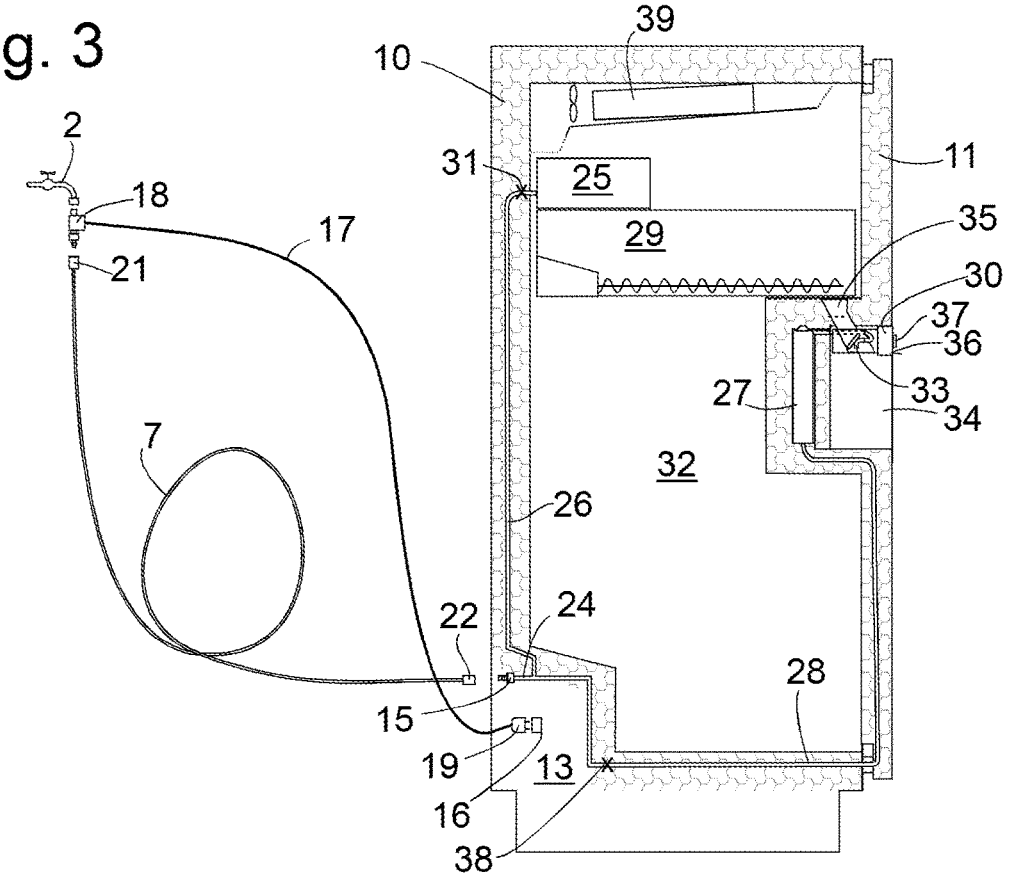
FIG. 3 is a vertical-sectional view of the refrigerating appliance and a view of associated components laid out for installation according to a first embodiment of the invention.

As is shown in FIG. 3, when the refrigerator cabinet 9 is installed, the solenoid valve 18 is connected to an outlet of the spigot 2, and the connector 19 is plugged into the connector 16. Any length of the cable 17 which is not needed for spanning the distance between the refrigerator cabinet 9 and the spigot 2 may be left hanging from the hook 20, so that it will not clutter the floor below the refrigerator body 10.

The hose 7 is connected to the outlet of the solenoid valve 18 and to the water inlet connector 15. Since the diameter of the hose 7 is small, it can pass sharp bends such as a bend 23 shown in FIG. 1, without kinking, and there is little risk that the hose 7 will be damaged during installation.

An internal pipe 24 of the refrigerator cabinet 9 extends from the connector 15. The internal pipe 24 supplies water to an ice maker 25 through a first branch 26 and to a water tank 27 of a cold water dispensing unit through a second branch 28.

The ice maker 25 is known as such and is therefore not shown in detail. It includes an ice tray in which ice cubes are formed. When the ice cubes are ready, the tray is turned over and twisted in order to eject the ice cubes into a storage bin 29. Then the tray is turned back into an upright position, and the tray is refilled with water from the pipe 24. In order to refill the tray, an electronic controller 30 provides valve opening signals to a solenoid valve 31 located close to a downstream end of the branch 26 and, through terminals of the connector 16, to the solenoid valve 18. Since the terminals are well protected from unintentional contact with a user's fingers inside the connector 16, mains voltage can be used for powering and controlling the solenoid valve 18. The duration of the opening signal supplied to the solenoid valve 18 is controlled so that the quantity of water that is let through is just sufficient to fill the tray. The opening signal supplied to the solenoid valve 31 may end a fraction of a second later than that of the valve 18, so that the water pressure in the hose 7 and the internal pipe 24 drops to ambient pressure before the valve 31 closes as well.

The water tank 27 is located within an insulating layer of the door 11, so that the water in it is cooled to a temperature between ambient temperature and that of a storage compartment 32 inside the cabinet 10, safely above the freezing temperature. The cold water dispensing unit further includes a water outlet 33 at the ceiling of a dispenser niche 34 which communicates with the tank 27, adjacent an ice chute 35 from the storage bin 29. While a user presses a button 37 on an operating panel 36 above the dispenser niche 34, the electronic controller 30 provides valve opening signals to the valve 18 and to a valve 38 located in the branch 28. While both valves 18, 38 are open, fresh water flows into the tank 27 and cold water from the tank 27 flows to the water outlet 33. When the user releases the button 37, the valve opening signal supplied to the valve 18 stops, and the valve 18 closes. Immediately afterwards, the opening signal supplied to the valve 38 also stops, so that in this case too, the hose 7 is depressurized.

Even if a leak should form in the hose 7 or between the connectors 22 and 15, water will escape from it only while either the ice maker or the water dispenser draws water, since at other times, the hose 7 is under ambient pressure. While one of ice maker and water dispenser draws water, the water flow ensures that pressure in the pipe 24 is lower than in the water mains, so that even at these times, stress on the hose 7 is low.

If there is a leak between the connectors 22 and 15, water that escapes through it will be caught in the evaporation dish 14 underneath, and to a certain extent it can be evaporated there along with condensate from the evaporator 39 without causing any problems. As an additional safety measure, a water level sensor 42 seen in FIG. 2, which may be provided at the evaporation dish 14, triggers an alarm if the water level rises in the dish 14 above a predetermined level.

If desired, a non-illustrated protective tube might be provided through which the hose 7 extends. The protective tube can be open at both ends, or one end of it can be connected to a casing of the solenoid valve 18 so as to catch any water that might leak from there. Since the location of the water spigot 2 at the wall 1 is usually higher than that of the connectors 22, 15, any leakage water which is caught in the protective tube will finally escape from its downstream end, fixed to the connector 22, and will cause the water level sensor 42 to produce an alarm.

Figure 4:
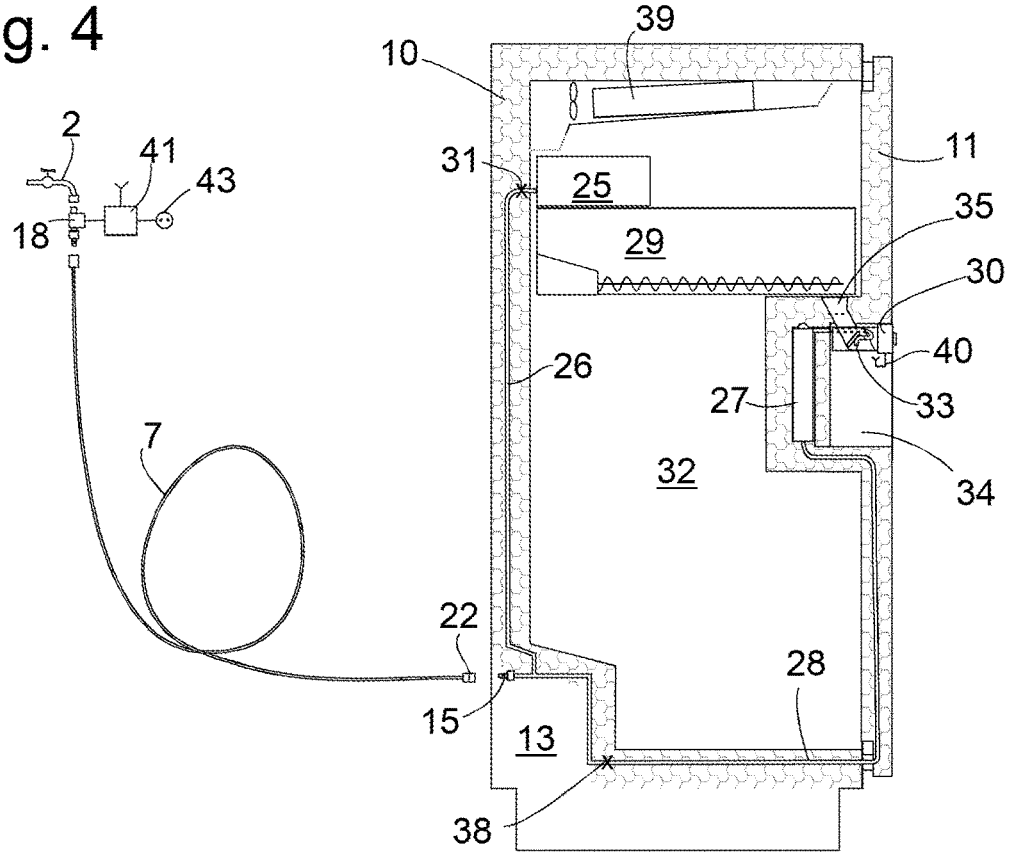
FIG. 4 is a vertical-sectional view of a refrigerating appliance and its associated components according to a second embodiment of the invention.

According to a second embodiment shown in FIG. 4 there is no wired signal connection between the electronic controller 30 and the solenoid valve 18. Instead, the controller 30 includes a radio transmitter 40, e.g. a Bluetooth interface, and a corresponding receiver 41 which receives the valve opening signal is associated with the solenoid valve 18. Installation of the refrigerator is thus simplified, since the only connection which still has to be established between the refrigerator and the solenoid valve 18 is by the hose 7. Operating power may be provided to the solenoid valve 18 and the receiver 41 by any conveniently located mains socket 43.

Alternatively, the transmitter 40 can be a power line transmitter which communicates with the receiver 41 not by radio waves but by an AF signal modulated onto the mains voltage by the transmitter 40 and demodulated by the receiver 41.

The following is a summary list of reference numerals and the corresponding structure used in the above description of the invention:

1 Wall
2 water spigot or faucet
3 sink
4 sink-top faucet
5 dishwasher
6 refrigerator
7 hose
8 corner cupboard
9 refrigerator cabinet
10 body
11 door
12 machinery compartment
13 compressor
14 evaporation dish
15 water inlet connector
16 electric connector
17 cable
18 solenoid valve
19 male connector
20 hook
21 connector
22 connector
23 bend
24 pipe
25 ice maker
26 first branch
27 water tank
28 second branch
29 storage bin
30 controller
31 solenoid valve
32 storage compartment
33 water outlet
34 dispenser niche
35 ice chute
36 operating panel
37 button
38 valve
39 evaporator
40 transmitter

41 receiver
42 water sensor
43 mains socket

The invention claimed is:

1. A refrigerating appliance, comprising:

a cabinet;

a normally closed external valve configured for being disposed external to the cabinet in a supply line supplying water to the refrigerating appliance;

a dispenser mounted within said cabinet for dispensing ice or water;

a valve controller configured to output a valve opening signal when said dispenser requires water;

a cable connected to said valve controller for providing the valve opening signal to said external valve; and a water supply hose, a connector for said water supply hose and a collecting dish underneath said connector, said water supply hose being disposed in a protective tube having a downstream end leading to said collecting dish.

2. The refrigerating appliance according to claim 1, which further comprises at least one valve controlled by the valve opening signal and disposed within said cabinet.

3. The refrigerating appliance according to claim 1, wherein:

said dispenser includes a cold water dispensing unit having a water supply line and an ice maker having a water supply line;

a first valve is located in said water supply line of said cold water dispensing unit;

a second valve is located in said water supply line of said ice maker; and said device makes valve opening signals available for said first and second valves.

4. The refrigerating appliance according to claim 1, which further comprises a terminal on an outside of said cabinet and a connector socket in which said terminal is disposed.

5. The refrigerating appliance according to claim 1, which further comprises a connector disposed on said cabinet and a water supply hose detachably connected to said external valve and to said connector.

6. The refrigerating appliance according to claim 1, which further comprises a water supply hose, said cabinet having a connector for said water supply hose and a leakage detector associated with said connector.

7. The refrigerating appliance according to claim 6, wherein said leakage detector includes a collecting dish underneath said connector and a water sensor associated with said collecting dish.

8. The refrigerating appliance according to claim 7, wherein said collecting dish is or communicates with an evaporation dish, and said water sensor is configured to monitor a water level in said evaporation dish.

9. A refrigerating appliance, comprising:

a cabinet;

a normally closed external valve configured for being disposed external to the cabinet in a supply line supplying water to the refrigerating appliance;

a dispenser mounted within said cabinet for dispensing ice or water;

a valve controller configured to output a valve opening signal when said dispenser requires water;

a cable connected to said valve controller for providing the valve opening signal to said external valve;

a further valve disposed within an internal pipe in said cabinet, said valve controller being configured for having said further valve close after said external valve to allow water pressure to drop in said internal pipe; and a water supply hose, a connector for said water supply hose and a collecting dish underneath said connector, said water supply hose being disposed in a protective tube having a downstream end leading to said collecting dish.

10. A refrigerating appliance, comprising:

a cabinet;

a normally closed external valve configured for being disposed external to the cabinet in a supply line supplying water to the refrigerating appliance;

a dispenser mounted within said cabinet for dispensing at least one of ice or water;

a valve controller configured to output a valve opening signal when said dispenser requires water;

a terminal for powering and controlling the solenoid valve;

a cable connected between said terminal and said external valve, said cable powering said external valve and providing the valve opening signal to said external valve; and a water supply hose, a connector for said water supply hose and a collecting dish underneath said connector, said water supply hose being disposed in a protective tube having a downstream end leading to said collecting dish.

* * * * *